United States Patent [19]

Pritulsky

[11] Patent Number: 4,515,422

[45] Date of Patent: May 7, 1985

[54] PIN RECEPTACLE INTENDED FOR MOUNTING IN A CIRCUIT BOARD

[75] Inventor: James Pritulsky, Harrisburg, Pa.

[73] Assignee: AMP Incorporated, Harrisburg, Pa.

[21] Appl. No.: 543,210

[22] Filed: Oct. 19, 1983

[51] Int. Cl.[3] ..... H01R 23/72

[52] U.S. Cl. ..... 339/17 C; 339/147 P

[58] Field of Search ..... 339/17 R, 17 C, 256 R, 339/256 RT, 258 R, 258 A, 258 P, 275 B, 147 P

[56] References Cited

U.S. PATENT DOCUMENTS

| | | | |
|---|---|---|---|
| 3,506,942 | 4/1970 | Alimena | 339/17 R |
| 3,528,173 | 9/1970 | Gall et al. | 29/626 |
| 3,548,369 | 12/1970 | Garver | 339/17 C |
| 3,877,769 | 4/1975 | Berg et al. | 339/17 R |
| 3,937,553 | 2/1976 | Maximoff et al. | 339/275 B |

FOREIGN PATENT DOCUMENTS

| | | |
|---|---|---|
| 0057757 | 8/1982 | European Pat. Off. . |
| 938341 | 10/1963 | United Kingdom . |

OTHER PUBLICATIONS

IBM Technical Disclosure Bulletin, B. R. Kryzaniwsky, "Barrel Connector", vol. 14, No. 9, Feb. 1972, p. 2599.

*Primary Examiner*—Neil Abrams

*Attorney, Agent, or Firm*—F. W. Raring; R. W. J. Usher

[57] ABSTRACT

Pin receptacle intended for mounting in a circuit board comprises a hollow metallic cylindrical member having first and second ends. A contact lance is struck or sheared from the cylindrical member and has a fixed end that is adjacent to the second end of the cylindrical member. The contact lance extends inwardly from its fixed end to the interior of the receptacle and has a pin contacting portion intermediate its ends. An end portion of the lance is reversely curved and extends through the opening formed by the shearing operation to the exterior of the cylindrical member. A circuit board conductor contacting portion is on the end of the lance. Stop lances are also struck from the cylindrical member adjacent to the second end and extend obliquely from its surface. Anti-overstress lances are also struck from the cylindrical member and extend obliquely towards the second end of the cylindrical member. When the receptacle is mounted in a hole in a circuit board, the surfaces of the board are contacted by the stop lances and the anti-overstress lances. The contact lance is positioned above the one surface of the circuit board with the contact portion or zone in engagement with end against the circuit board conductor.

7 Claims, 8 Drawing Figures

PIN RECEPTACLE INTENDED FOR MOUNTING IN A CIRCUIT BOARD

BACKGROUND OF THE INVENTION

It is frequently necessary to mount an electrical device, such as a coil or a transformer, adjacent to or on a circuit board and to connect the leads extending from the electrical device to conductors on the circuit board. This is sometimes done by providing pin contacts extending from the electrical device and tubular receptacles in the circuit board which are soldered to the circuit board conductors. The soldering operation is time consuming and frequently must be carried out as a separate step in the manufacturing process thus greatly contributing to the finished cost of the article being produced. The present invention is directed to the achievement of an improved receptacle which does not require soldering to the circuit board and which can be assembled to the circuit board by simply inserting the socket into a circuit board hole.

The invention is further directed to an improved combination of a circuit board having an electrical device such as a coil mounted thereon which is connected to conductors on the circuit board and having an electrical component such as a resistor connected across the leads extending from the electrical device to the circuit board.

A preferred embodiment of the invention comprises a pin receptacle which is intended to be mounted in a circuit board hole in a circuit board having first and second surfaces and having at least one conductor on the first surface. The pin receptacle is a hollow stamped end formed tubular member or cylinder having a first end and a second end, the pin receptacle being intended for mounting in the circuit board hole with the first end proximate to, and spaced from, the first surface and with the second end proximate to and spaced from the second surface. The pin receptacle has a pin contacting portion and a conductor contacting portion intermediate its end for contacting an inserted pin and for contacting the circuit board receptacle. The pin receptacle is characterized in that a spring contact lance or contacting arm is struck from the cylinder between the first and second ends thereof, the spring contact lance having a fixed end which is integral with the pin receptacle at a location proximate to the second end thereof. The lance has a free end and extends in the general direction of the axis of the cylinder towards the first end thereof. The lance extends from the fixed end into the interior of the cylinder and extends from the interior of the cylinder radially to the exterior thereof to its free end. The pin contacting portion is on the contact lance intermediate to its ends and is located in the interior of the cylinder and the conductor contacting portion is adjacent to the free end of the contact lance. At least two locking members are formed on the pin receptacle and extend radially outwardly from the surface thereof. The locking members are spaced apart circumferentially on the surface of the cylinder whereby upon placement of the pin receptacle in a circuit board hole with the locking members adjacent to one surface of the circuit board and with the contact portion of the locking lance against the circuit board conductor, and upon insertion of a contact pin into the pin receptacle, the contact pin will be electrically connected to the circuit board conductor.

In accordance with further embodiments of the invention, the locking members are locking lances which are struck from the surface of the cylinder and which extend from their fixed ends towards the first end of the cylinder and extend obliquely away from the surface of the cylinder. One or more anti-overstress lances may also be provided in the pin receptacle, each of the first stress lances having a fixed end which is proximate to the first end of the pin receptacle and which extends towards the second end and obliquely away from the surface of the cylinder. When the receptacle mounted in a circuit board, the anti-overstress lances bear against the other surface of the board and prevent damage to the contact lance in the event that an axial force is applied on the first end of the cylinder.

In accordance with a further embodiment, connecting devices may be assembled to the contact pins extending from the electrical device. The connecting devices have receptacle portions which receive the leads of a circuit component or they may receive edge portions of a small circuit board or which one or more circuit components are mounted. By means of these connectors mounted on the contact pins, circuit components can be connected across the contact pins at a location adjacent to the circuit board on which the electrical device is mounted.

THE DRAWING

Figure 1:
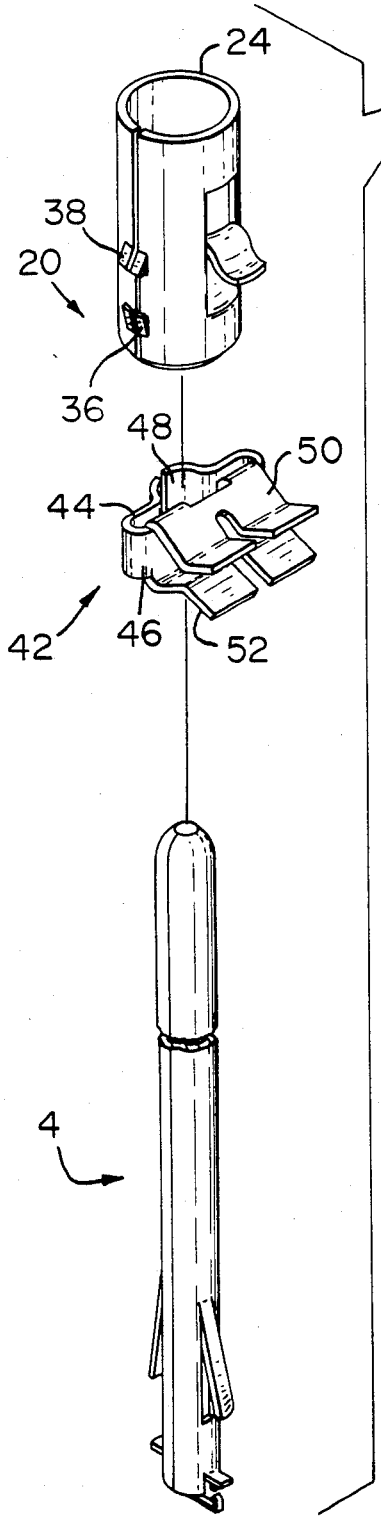
FIG. 1 is a perspective view showing a pin receptacle, a connector for mounting on a pin extending from an electrical device, and a pin which is intended for mating with the receptacle.
Figure 3:
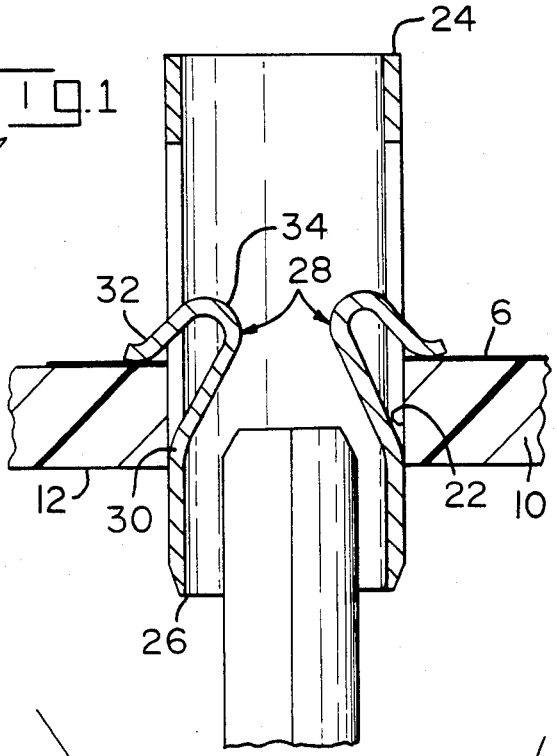
FIG. 3 is an enlarged fragmentary view of the pin receptacle mounted in a circuit board hole with a contact pin in alignment with the receptacle.
Figure 4:
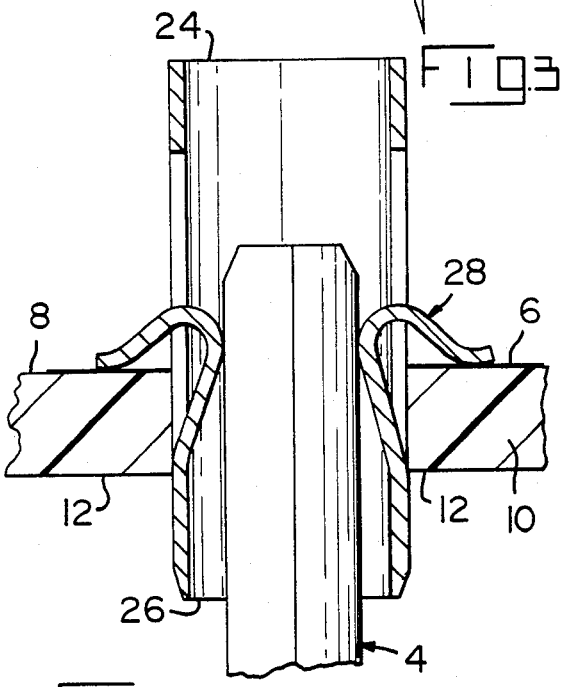
FIG. 4 is a view similar to FIG. 3 but showing the pin in its inserted position.
Figure 2:
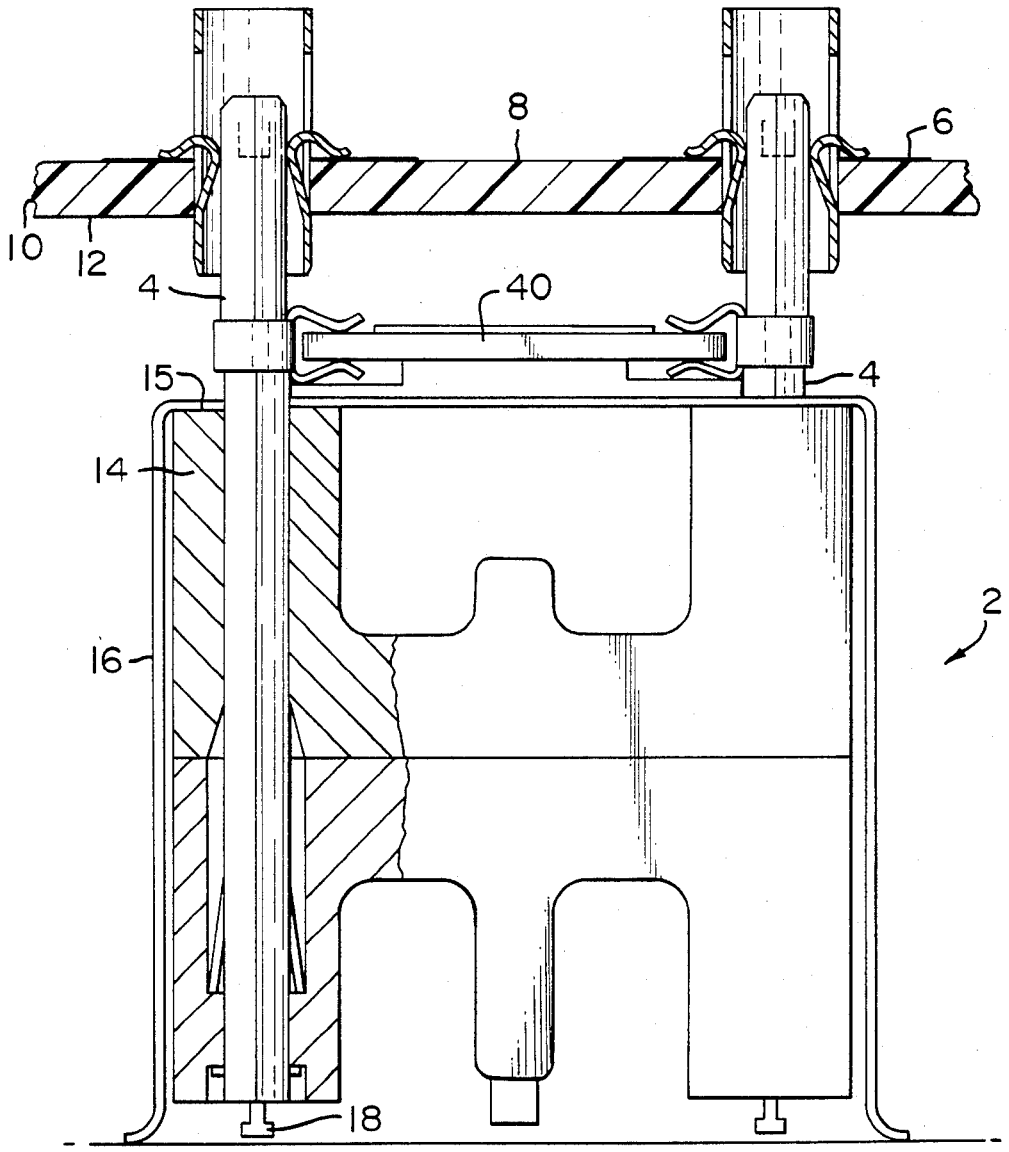
FIG. 2 is a side view, partially in section, showing an electrical device mounted on a circuit board and having pins extending therefrom which are connected to conductors on the circuit board by receptacles in accordance with the invention.

FIG. 2 shows an electrical coil 2 having spaced apart parallel contact pins 4 extending from one of its ends 15. The contact pins 4 are connected to conductors 6 on the upper surface 8 of a circuit board 10 having a lower surface or second surface 12. The coil 2 comprises a bobbin 14 of insulating material having windings thereon and having a metal case or shell 16. The ends of the windings extend to, and are connected to, terminals 18 on the lower ends, as viewed in FIG. 1, of the pins 4. The terminal pins 4 are connected to the conductors 6 by means of pin receptacles 20 which will now be described.

Each of the pin receptacles of the embodiment of FIGS. 1–4 comprises a hollow stamped and formed cylinder having a first or upper end 24 and a lower or second end 26. A pair of contact lances 28 are struck from the cylinder at opposite locations and each lance has a fixed end 30 which is proximate to and spaced from the second end 26 of the cylinder. Each contact lance 28 extends from its fixed end obliquely into the interior of the cylinder and towards the first or upper end 24. Intermediate its ends, each lance has a reverse bend as show at 34, the surface of which serves as a pin contacting portion for contacting an inserted pin 4. Each lance has an end portion which extends to the free end 32 of the lance and the lance is again reversely bent to a slight extent at its free end. The free end of each lance bears against a surface conductor 6 as shown.

A pair of smaller locking lances or stop lances 36 are also provided adjacent to the second end 26 and extend from the surface of the cylinder away from the axis thereof and upwardly as viewed in the drawing towards the first end. When the receptacle is installed in the circuit board 10, these lances bear against the surface 12 of the board.

It is desirable to provide in addition to the locking lances 36, a pair of anti-overstress lances 38 which are opposed to the stop lances and which extend away from the surface of the cylinder and towards the second end 26.

The pin receptacles 20 are installed in the holes 22 in the circuit board by positioning the receptacles above the first surface 8 and in alignment with the circuit board holes. The receptacles are then moved downwardly, as viewed in the drawing until the stop lances 36 move past the second surface 12 of the circuit board. When the stop lances are immediately beneath the surface 12, the anti-overstress lances 38 will be substantially against the upper surface or the first surface 8 so that the receptacle cannot move in either direction. After installation, the contact portions of the contact lances will also be against the surfaces of the conductors 6 on the circuit board.

When the contact pins 4 of the electrical device 2 are inserted into the receptacles 20, the pins will engage the pin contact portions of the lances 28 and will flex them outwardly from the axes of the receptacles. As a result of such flexure, the circuit board contact portions on the ends of the lances will be moved over the surfaces of the conductors 6 and a wiping action will thereby be achieved and will assure good electrical contact between the lances and the conductor 6. Also, the lance is stressed and resiliently biased against the conductor so that a high contact force is achieved.

The anti-overstress lances 38 are desirable for the reason they protect the contact lances from damage in the event that a force is applied to the first or upper ends 24 of the receptacles. If such a force is applied, it will be transmitted by way of the anti-overstress lances to the surface of the circuit board rather than being transmitted through the contact lances 28. If the force were to be transmitted to the contact lances, damage could result if the lances were bent outwardly as a result of the force.

When an electrical device 2 is mounted on a circuit board 10, it is sometimes necessary to connect a circuit component such as a resistor or a capacitor across the leads extending from the electrical device. In accordance with the present invention, a stamped and formed edge connector 42 can be provided on each of the terminal pins 4 for reception of leads from a circuit component 40 which may comprise a resistor or the like. Each of the connectors 42 comprises a stamped and formed member having parallel strip-like sections 44, 46 between which the contact pin 4 is received. The strip 44 may be arcuately formed as shown at 48 so as to conform to the curvature of the pin 4. A pair of receptacle tabs 50, 52 extend from the section 46 and receive the ends of the component 40 between their opposed surfaces as shown in FIG. 1.

It will be apparent from the foregoing description that pin receptacles in accordance with the invention can be mounted in circuit board holes by merely moving the receptacles axially into the holes until the locking lances and the anti-overstress lances are against the surfaces of the circuit board. This inserting operation can advantageously be carried out by an automatic or semi-automatic machine and the receptacles 20 can be produced in continuous strip form for high speed low cost insertion. Once inserted, the receptacles cannot be removed and when the electrical device is later mounted on the circuit board by inserting the contact pins 4 into the receptacles, the contact portions of the lances will move over the circuit board conductors 6 thus ensuring clean surface at the electrical interface and good electrical contact. In addition, components such as resistors 40 can be connected across the pins as described.

Figure 5:
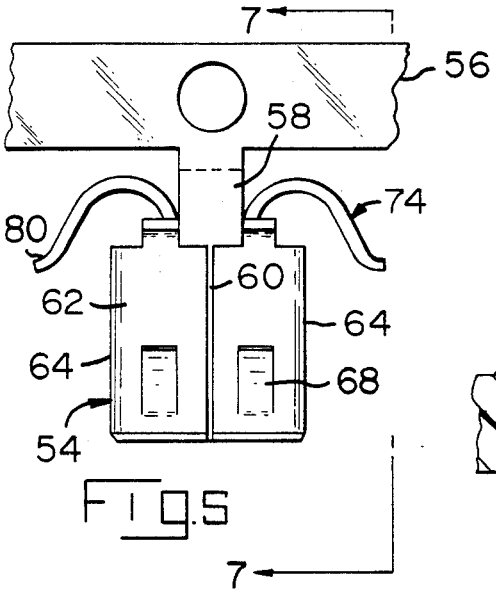
FIG. 5 is a perspective view of a further embodiment of the invention.
Figure 6:
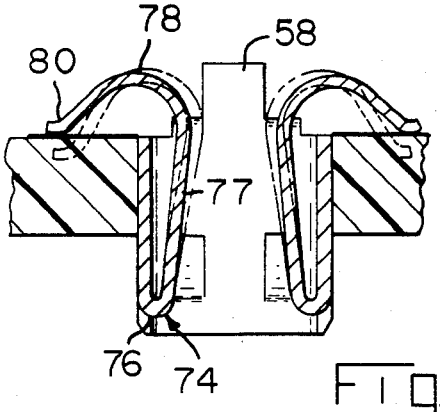
FIG. 6 is a cross-sectional view of the receptacle of FIG. 5 installed in a circuit board.
Figure 7:
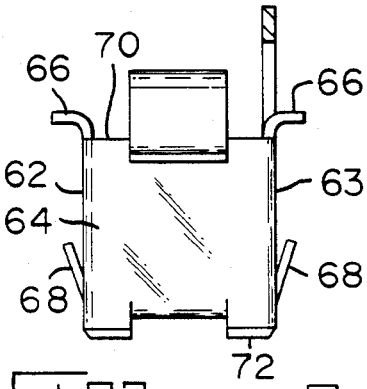
FIG. 7 is a view taken along the lines 7—7 of FIG. 6.

FIGS. 5–7 show an alternative embodiment of the invention comprising a receptacle 54 which has a square cross section and which is intended for insertion into a square hole in the circuit board 10. Receptacles of the type shown in FIGS. 5–8 are manufactured in continuous strip form with each receptacle connected to a carrier strip 56 by a connecting section 58. The connecting section extends from the upper or first end 70 of the receptacle and from the side 63. The side 62 which is opposite to the side 63 has an axially extending open seam 60.

Anti-overstress ears 66 extend from the edges of the sides 63, 62 at the first end of the receptacle and laterally over the surface of the circuit board hole. Locking lances 68 are struck from the sides 62, 63 adjacent to the second or the lower end 72 and extend obliquely away from the surfaces of the side 62, 63. These lances 68 bear against the lower surface 12 of the circuit board.

In the embodiment of FIGS. 5–8, the contact members for contacting the conductors 6 on the upper surface of the circuit board comprise relatively long contacting arms in the form of spring members 74 which extend from the sides 64 of the receptacle. These spring members are reversely formed inwardly and towards each other at 76 and have intermediate portions 77 which extend upwardly as viewed in FIG. 6 through the interior of the receptacle. The spring members extend above the upper end 70 and are again reversely formed as shown at 78 so that their free ends 80 are beyond the sides 64 of the receptacle. The free ends bear against the conductor 6 as previously explained and when the contact pin 4 is inserted into the receptacle, the springs are flexed outwardly and the contact areas on the free ends wipe over the surfaces of the conductors to obtain good electrical contact.

Figure 8:
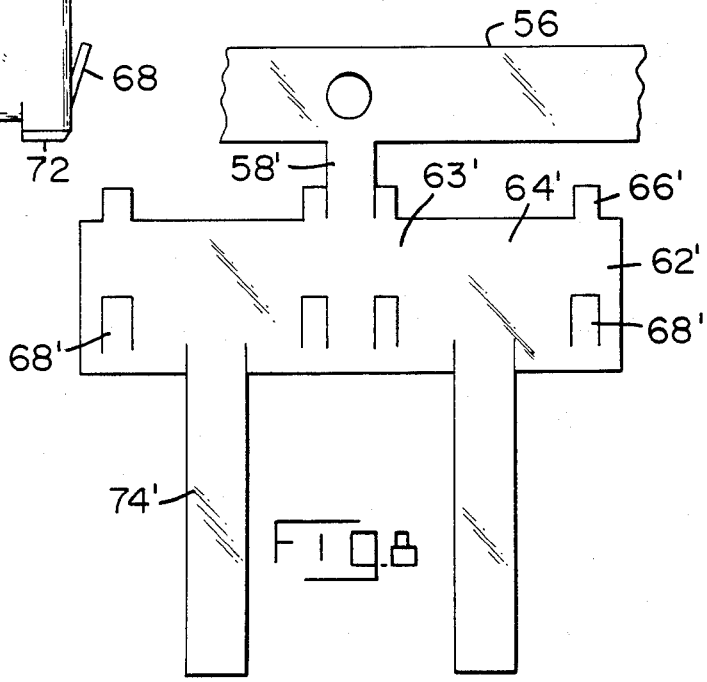
FIG. 8 is a plan view of the blank from which the receptacle of FIG. 5 is formed.

FIG. 8 shows the blank from which the receptacle in FIG. 5 is formed. The parts of the blank are identified with the same referenced numerals, differentiated by primed marks, as those used in the foregoing description of the formed receptacle.

A comparative advantage of the embodiment of FIGS. 5–8 is that the height of the receptacle above the upper surface of the circuit board is reduced as compared with the embodiment shown in FIGS. 1–4. This reduction is possible for the reason that the springs or contact members are not struck from the body of the receptacle but are rather extensions of the sides 64 as is apparent from inspection of the blank of FIG. 8. Additionally, the spring members 74 of the embodiment of FIGS. 5–8 are relatively longer than contact lances 28 of the embodiment of FIGS. 1–4 and the designer therefore has more control over the performance of the spring.

I claim:

1. A pin receptacle which is intended to be mounted in a circuit board hole in a circuit board having first and second surfaces and having at least one conductor on the first surface which extends to the circuit board hole, the pin receptacle being a hollow tubular stamped and formed member having a first end and a second end, the pin receptacle being intended for mounting in the circuit board hole with the first end proximate in the first surface and with the second end proximate in the second surface, the pin receptacle having a pin contacting portion and a conductor contacting portion for contacting an inserted pin and for contacting the circuit board conductor, the pin receptacle being characterized in that:

the tubular member has a contacting arm extending therefrom, the contacting arm having a fixed end which is integral with the tubular member proximate to the second end of the tubular member, an intermediate portion, and a free end portion, the contacting arm being reversely bent inwardly of the tubular member adjacent the fixed end through an angle of substantially 180° so that the intermediate portion extends into the interior of the tubular member, the pin contacting portion being on the intermediate portion, the free end portion extending laterally from the intermediate portion and away from the axis of the tubular member, the conductor contacting portion being on the free end portion whereby upon placement of the pin receptacle in a circuit board hole with the conductor contacting portion of the contacting arm against the circuit board conductor, and upon insertion of a contact pin into the pin receptacle, the contact pin will be electrically connected to the circuit board conductor.

2. A pin receptacle as set forth in claim 1 characterized in that the intermediate portion of the contacting arm extends beyond the first end of the tubular member.

3. A pin receptacle as set forth in claim 1 characterized in that the tubular member has at least one locking member extending therefrom proximate to the second end of the tubular member, the locking member extending radially outwardly and being engageable with the second surface of the circuit board.

4. A pin receptacle as set forth in claim 3 characterized in that an anti-overstress member extends radially outwardly from the first end of the tubular member.

5. A pin receptacle as set forth in claim 1 characterized in that the tubular member is a right circular cylinder.

6. A pin receptacle as set forth in claim 1 characterized in that the tubular member has a rectangular cross section.

7. An electrical assembly of a contact pin received in a pin receptacle mounted in a circuit board hole in a circuit board having first and second surfaces and having at least one conductor on the first surface which extends to the circuit board hole, the pin receptacle being a hollow tubular stamped and formed member having a first end and a second end, the pin receptacle being mounted in the circuit board hole with the first end proximate the first surface and with the second end proximate the second surface and the contact pin being received in the receptacle through an end, the pin receptacle having a pin contacting portion and a conductor contacting portion for contacting an inserted pin and for contacting the circuit board conductor, the pin receptacle being characterized in that:

the tubular member has a contacting arm extending therefrom, the contacting arm having a fixed end which is integral with the tubular member proximate to the second end of the tubular member, an intermediate portion, and a free end portion, the intermediate portion extending into the interior of the tubular member, the pin contacting portion being on the intermediate portion, the free end portion extending laterally from the intermediate portion, laterally outwardly of the tubular member and away from the axis of the tubular member, the conductor contacting portion being on the free end portion whereby engagement of the contact pin with the pin contacting portion urges the conductor contacting portion of the contacting arm against the circuit board conductor to effect electrical termination therewith.

* * * * *